US006220852B1

(12) United States Patent
Moore

(10) Patent No.: US 6,220,852 B1
(45) Date of Patent: Apr. 24, 2001

(54) VARIABLE EXIT HIGH VELOCITY BURNER

(75) Inventor: Edward E. Moore, Hummelstown, PA (US)

(73) Assignee: Hauck Manufacturing Company, Lebanon, PA (US)

( * ) Notice: Subject to any disclaimer, the term of this patent is extended or adjusted under 35 U.S.C. 154(b) by 5 days.

(21) Appl. No.: 09/583,531

(22) Filed: Jun. 1, 2000

Related U.S. Application Data

(63) Continuation of application No. 09/275,776, filed on Mar. 25, 1999, now abandoned.

(51) Int. Cl.[7] ..... F23C 1/12; F23C 7/00

(52) U.S. Cl. ..... 431/8; 431/12; 431/158; 431/159; 431/189; 432/159; 239/265.19; 60/242; 60/271

(58) Field of Search ..... 431/8, 9, 12, 158, 431/159, 182, 183, 181, 186, 189, 187, 354, 353; 239/460, 456, 417, 417.633, 505, 265.19, 514, 265.25, 515, 265.27, 408, 533.2, 533.6; 60/204, 242, 271, 39.77, 39.78, 39.25

(56) References Cited

U.S. PATENT DOCUMENTS

| | | | |
|---|---|---|---|
| 759,320 | | 5/1904 | Schutte . |
| 825,290 | * | 7/1906 | Barker . |
| 1,903,100 | * | 3/1933 | Estering . |
| 1,980,266 | * | 11/1934 | Goddard ..... 60/39.8 |
| 2,483,401 | * | 10/1949 | Cole . |
| 2,565,039 | | 8/1951 | Mueller . |
| 2,583,570 | * | 1/1952 | Hickman . |
| 2,963,864 | | 12/1960 | Gross . |
| 2,971,327 | * | 2/1961 | Moy et al. . |
| 3,533,717 | * | 10/1970 | Guerin . |
| 3,663,153 | | 5/1972 | Bagge et al. . |
| 3,782,884 | | 1/1974 | Shumaker . |
| 4,062,343 | * | 12/1977 | Spielman . |
| 4,475,883 | | 10/1984 | Schirmer et al. . |
| 4,902,222 | | 2/1990 | van Belle . |
| 5,038,559 | * | 8/1991 | Blackmore . |
| 5,199,355 | * | 4/1993 | Larue . |
| 5,199,866 | * | 4/1993 | Joshi et al. . |
| 5,263,849 | | 11/1993 | Irwin et al. . |
| 5,292,244 | | 3/1994 | Xiong . |
| 5,570,679 | | 11/1996 | Wunning . |

FOREIGN PATENT DOCUMENTS

| | | | | |
|---|---|---|---|---|
| 384760 | * | 2/1938 | (DE) | 431/186 |
| 1145211 | * | 3/1985 | (SU) | 431/349 |

* cited by examiner

*Primary Examiner*—Carl D. Price
(74) *Attorney, Agent, or Firm*—Evenson, McKeown, Edwar & Lenathan, P.L.L.C.

(57) ABSTRACT

A method and apparatus for adjusting the flame exit velocity of a high velocity burner. The burner includes burner combustor chamber having a fluid accelerating nozzle and a burner combustor exhaust port. Fuel is delivered to the burner combustor through a fuel inlet. An ignitor is provided to initiate combustion of the fuel which is mixed with air from an air inlet. An adjusting device is provided to vary the flame exit area of the burner. The adjusting device includes an adjusting rod connected to an extension rod which preferably extends through the burner ignition chamber to the burner combustion exit port. For example, a tapered plug is attached to the end of the extension rod. The tapered plug is tapered in a direction decreasing toward the burner combustion exit port and can include fins attached around a periphery of the plug.

4 Claims, 2 Drawing Sheets

VARIABLE EXIT HIGH VELOCITY BURNER

This application is a continuation of application Ser. No. 09/275,776, filed Mar. 25, 1999 now abandoned.

BACKGROUND OF THE INVENTION

1. Field of the Invention

The present invention relates to a high velocity burner, and more particularly, a variable exit high velocity burner. The variable exit provides a mechanism for controlling the actual flame exit velocity over a wide range of burner operation variables.

2. Description of Related Art

High velocity burners are a heating source preferred for most industrial furnaces and kilns. In these types of burners, such as those described in U.S. Pat. Nos. 5,570,679 and 5,263,849, fuel and combustion air are mixed with and ignited in a high-heat-resistant combustion chamber. The resultant hot combustion gases flow at high velocity through a nozzle-shaped outlet into the heating chamber, which is formed either by the furnace chamber itself or by some other device. The outlet of the combustion chamber can be constricted in nozzle-like fashion or formed by a nozzle ring. The mechanical energy of the gas stream or jet emerging from the combustion chamber, which derives predominantly from the fuel and nozzle shape, serves to mix and circulate the gases in the heating chamber, which in turn promotes the temperature equalization in a desired manner. Exit flame velocity for this type of burner is in excess of 25,000 ft/min when then burner is at high fire. The high velocity promotes good flue gas circulation in the furnace or kiln resulting in good temperature uniformity.

In high velocity burners, however, the burners cannot always be operated at their maximum firing rate. The flame exit velocity decreases as the burner firing rate is decreased. Actual flame exit velocity is a function of flow rate, pressure drop, combustor exit area and flame temperature. Accordingly, it would be advantageous to control the flame exit velocity in a high velocity burner to account for these variables.

There are several types of known flow control devices for conventional burners. For example, U.S. Pat. No. 2,565,039 shows a burner having a nozzle member as a part of a mixing valve. A needle having a tapered end cooperates with an aperture to increase or decrease the area between the outer size of the tapered end of the needle. The area of the opening of the burner is adjusted by rotating a head on the threaded stud to obtain the desired opening for best performance.

U.S. Pat. No. 3,663,153 shows an LTG burner in which a central rod is provided with a cone-shaped downstream end to vary the width of the primary air supply opening. A similar arrangement is shown in the acid gas burner of U.S. Pat. No. 3,782,884.

Other movable plug arrangements are seen in U.S. Pat. No. 4,902,222 in which a conical valve body cooperates with a valve seat. The valve rod is moved in a predetermined manner to decrease air flowing through the bypass conduit and allowing more air to flow into the mixing cup and the combustion chamber. U.S. Pat. No. 5,292,244 also shows that the use of Venturi mixer formed by a movable hollow body to vary the fuel/air mixture introduced into a combustion chamber is well known. However, these devices are used primarily to control the flow of combustible material in or around the combustion chamber, and not at the flame exit area of the burner.

What is desired is an adjustable velocity exit area for a high velocity burner to adjust the flame exit velocity or to maintain a constant velocity over a range of modulated firing rates. Such an adjustment would allow the flame exit velocity to be optimized over a wide range of operating conditions once the burner is installed in a furnace or kiln.

SUMMARY OF THE INVENTION

It is, therefore, an object of the present invention to provide a high velocity burner having an adjustable flame exit orifice. The adjustability of the exit orifice allows the flame to be maintained at a constant velocity over a range of modulated firing rates.

To obtain these and other advantages, one aspect of the present is an adjustable velocity burner having variable flame exit. The burner includes burner combustor chamber having a fluid accelerating nozzle and a burner combustor exhaust port. Fuel is delivered to the burner combustor through a fuel inlet. An ignitor is provided to initiate combustion of the fuel. An adjusting device is provided to vary the flame exit area of the burner. The adjusting device includes an adjusting rod which preferably extends through the burner ignition chamber to the burner combustion exit port. In a currently preferred embodiment, a plug is attached to the end of the adjusting rod and is tapered in a direction decreasing toward the burner combustion exit port, and preferable includes fins attached around a periphery of the plug.

In one embodiment of the invention, the adjusting rod has a hand-manipulated operating device. However, the adjusting rod can have a computer controlled, machine manipulated operating device.

Another aspect of the present invention is a flame adjusting plug for a burner combustion assembly. The plug includes a conical tapered plug, having a first end of a first diameter and a second end of a second diameter, the second diameter being less than the first diameter. Preferably, the plug includes a plurality of fins arranged the periphery of the plug.

A further embodiment of the present invention is a method for adjusting the velocity of a flame at the exit of a burner assembly. The method includes the steps of delivering fuel to a combustion chamber of the burner and igniting the fuel in the combustion chamber. The method includes a further step of adjustable positioning a tapered burner plug in an exit opening of a burner combustion chamber and axially adjusting the position of the burner plug within the burner combustion exit port to vary the size of the burner combustion exit port opening.

These, together with other objects of the invention and along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated currently preferred embodiments of the invention.

BRIEF DESCRIPTION OF THE DRAWINGS

The invention will be better understood and objects other than those set forth above will become apparent when consideration is given to the following detailed description thereof which makes reference to the annexed drawings wherein.

DETAILED DESCRIPTION OF THE DRAWINGS

In order to effect changes in the exit flame velocity of a burner, I have recognized that the simplest and best solution is to change the exit area of the burner combustor. By adjusting the combustor exit port, the combustor exit area can be controlled externally. The flame exit velocity of the high velocity burner can be optimized for any firing rate by fixing the plug in the port to give the correct exit area.

Figure 1:
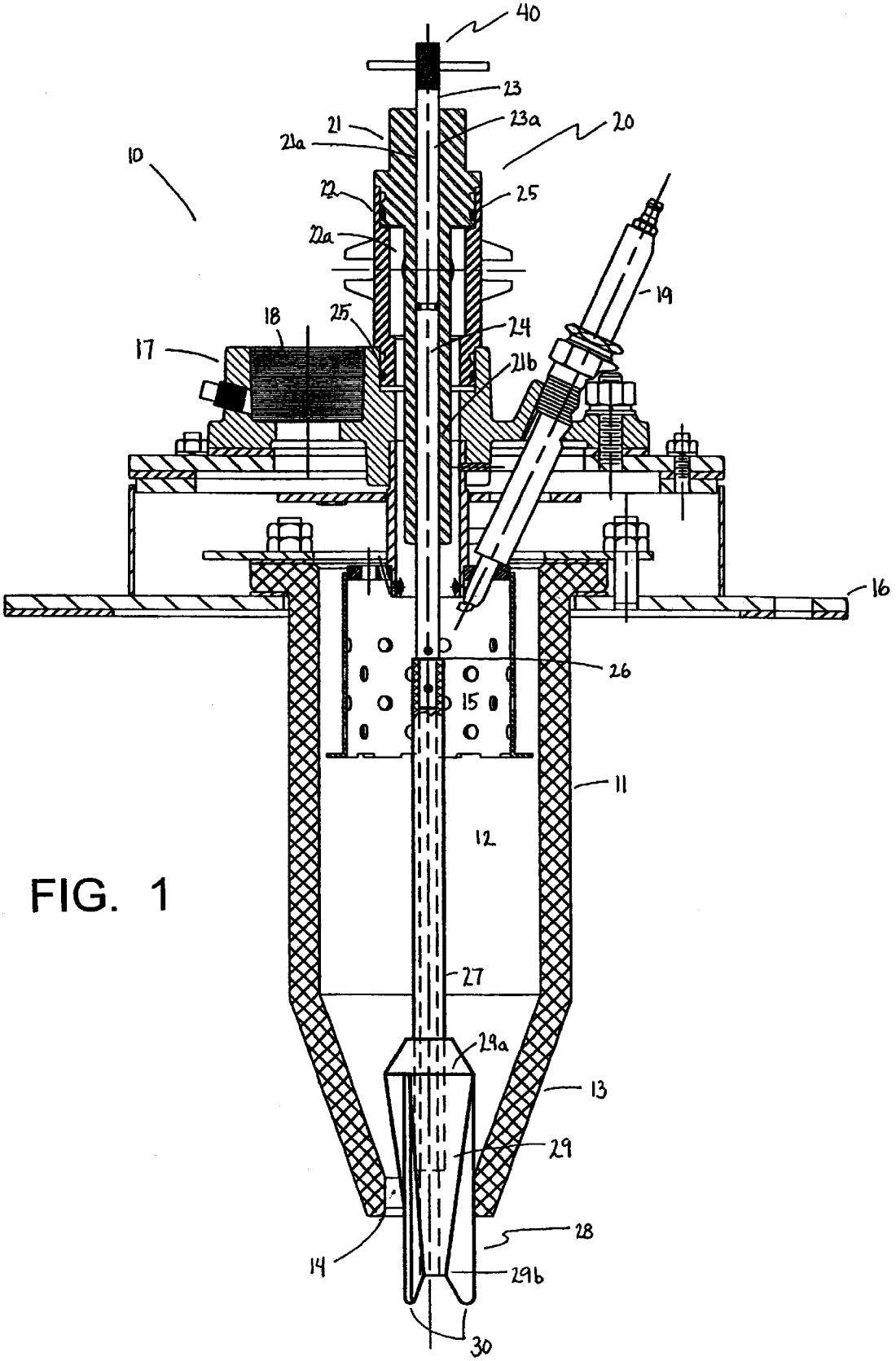
FIG. 1 is a cross-sectional side view a high velocity, adjustable flame exit burner according to an embodiment of the present invention.

FIG. 1 illustrates a currently preferred embodiment of the present invention in the form of an adjustable velocity burner designated by numeral 10. The burner could be used in a wide variety of devices, but is especially useful for furnaces and kilns where there is a need to maintain a consistent flame. Burner 10 comprises a burner combustor chamber 11 having a central burner ignition chamber 12, a fluid accelerating nozzle 13 and a burner combustor exhaust port 14. The burner 11 is mounted to a wall 16 of a furnace or kiln (which is not shown in greater detail) with screws by welding or the like. A mounting housing 17 is attached to wall 16 in a manner so as to both protect the burner 11 after it is mounted in the furnace or kiln, and to provide a support for other devices on the burner arrangement.

Combustion air for the burner is provided through an air inlet 18 in housing 17. Inside burner 11, an apertured cup-shaped flame holder 15 is provided at the combustion end of burner combustor chamber 11. Fuel is fed through a fuel inlet tube 22 having a fuel passage 22*a* and mixed with combustion air in the region of flame holder 15 where the mixture is ignited by ignitor 19, which is also mounted in housing 17. The flame produced is transferred via central burner ignition chamber 12 through the Venturi-like fluid accelerating nozzle 13 and burner combustor exit port 14 to the inside of the furnace or kiln. The cone shape of the burner arrangement through this path produces a pressure decrease of the combusted material and provides a high velocity flame out of burner combustor exit port 14. The foregoing are conventional features on a high velocity burner and need not be described in any greater detail.

Because a number of burner variables, such as flow rate, pressure drop, combustor exit area and flame temperature affect actual flame exit velocity, an adjusting device 20 is provided to control the burner combustor exit port 14 exit area in accordance with the invention. Adjusting device 20 includes an upper housing 21 connected with the fuel inlet tube 22 upstream of the flame holder 15. The tube 22 is preferably attached to housing 17 by a threaded fitting. Seals 25 are provided between the connection of housing 21 and tube 22, and between tube 22 and housing 17. A central bore 21a extends through the housing 21 and tube 22.

Adjusting device 20 further comprises an adjusting rod 23 which extends through the central bore 21*a* to the nozzle end of burner 10. The adjusting rod 23 may be a single piece of heat resistant material, such as a ceramic material and/or a multi-piece rod. As illustrated in FIG. 1, adjusting rod 20, which is in a fully retracted position, includes an upper rod 23*a* contained within central bore 21*a* of housing 21 and tube 22. At one end of upper rod 23*a,* a manual manipulator 40 is provided. The lower rod 24 extends through central bore 21*a* through flame holder 15. As illustrated the end of lower rod 24 has a threaded end 26 that attaches to an upper end of extension rod 27. Extension rod 27 extends through central burner ignition chamber 12 and fluid accelerating nozzle 13.

A tapered flame adjusting plug 28 is attached to the end of extension rod 27. Plug 28 is moveably positioned in the fluid accelerating nozzle 13. The tapered flame adjusting plug comprises a central tapered plug body 29 that is attached to the end of extension rod 27. Tapered plug body 29 is preferably formed out of a heat resistant material, such as a ceramic material. Plug body 29 can be formed as a tapered, truncated cone having an end of a first larger diameter 29*a* and a second smaller diameter end 29*b*. The larger diameter end 29*a* is attached to the end of extension rod 27. Tapered plug body 29 has a plurality of circumferentially distributed fins 30. A great advantage of the present invention is that the adjusting device can be retrofitted in conventional burners of the type described above.

Figure 2:
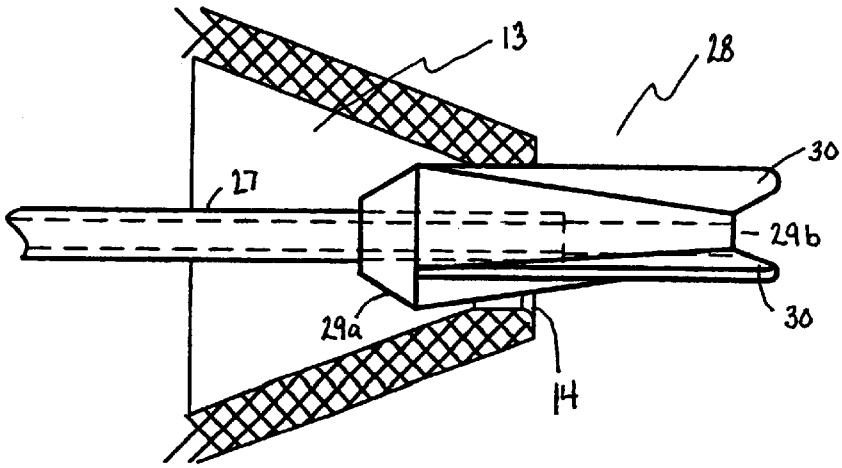
FIG. 2 is an isolated view of the plug arrangement shown in FIG. 1 in an extended position.
Figure 3:
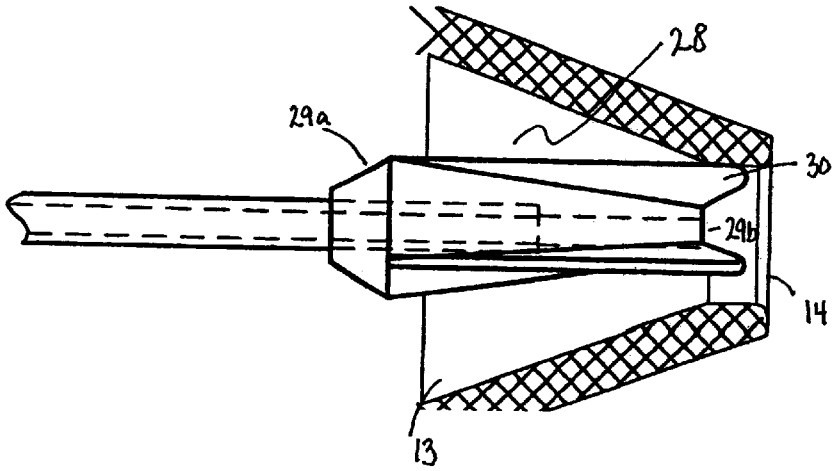
FIG. 3 is an isolated view similar to FIG. 2 but of the plug arrangement in a fully retracted position.

In operation, adjusting device 20 is arranged such that if manipulator 40 is turned either manually or by automated control equipment, flame adjusting plug 28 is caused to move in an axial direction within the fluid accelerating nozzle 13 and burner combustor exit port 14. As shown in FIG. 2, if adjusting plug 28 is moved outwardly of the burner combustor exit port 14 from the fully retracted position of FIG. 1 so that the larger diameter end 29*a* of plug 29 is moved into the burner combustor exit port 14, the exit area of burner combustor exit port 14 will decrease. If the manipulator 40 is moved to retract plug 29 into the burner 10 as illustrated in FIG. 3, the smaller diameter end 29*b* will be in burner combustor exit port 14, thereby increasing the exit area of the exit port 14 and decreasing the flame velocity. Movement of manipulator 40 can be done manually. Preferably, manipulator 40 is attached to an automatic moving device that is controlled by a computer. Thus, the exit area in the exit port 14 can be optimized over a wide range of burner firing rates and operating variables.

The movement of the tapered plug 29 within the exit area of the exit port 14 thus causes a geometric change in the exit area for the flame. This geometric change will effect the flame velocity as it exits the burner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of using a high velocity burner having a burner nozzle, a flame holder and a selectively controllable adjusting device arranged within a flame front produceable in the burner, comprising:

installing the burner in a furnace or kiln where a consistent flame is desired;

providing combustion air to the burner through a housing associated with the furnace or kiln;

feeding fuel to the burner and mixing the fuel with the combustion air in a region of the flame holder for ignition;

transferring a flame produced by the ignition through a venturi-like nozzle and burner combustion exit port to an interior of the furnace or kiln; and varying with the adjusting device, as necessary, an annular area of the exit port to obtain a desired flame property of the flame.

2. The method of claim 1, wherein the step of varying includes using an adjusting rod and an associated tapered plug which is tapered in a direction decreasing toward a burner combustion exhaust region and which has fins arranged around the periphery thereof.

3. The method of claim 1, wherein the step of varying is effected manually or automatically.

4. A method for adjusting velocity of a flame at an exit of a burner assembly installed on a furnace or kiln, comprising the steps of:

delivering a fuel-air mixture to a combustion chamber of the burner assembly;

igniting the fuel-air mixture in the combustion chamber to produce a flame which is transferred to an interior portion of the furnace or kiln;

adjustably positioning a tapered burner plug in an exit opening of the combustion chamber within a flame front of the produced flame; and axially adjusting the position of the burner plug relative to the exit port downstream of the beginning of the flame front to vary the size of the exit port and thereby maintain constant flame velocity over a range of modulated burner assembly firing rates.

* * * * *